United States Patent [19]

Smith et al.

[11] 4,262,183

[45] Apr. 14, 1981

[54] COMBINATION MICROWAVE/FORCED CONVECTION OVEN

[75] Inventors: Peter H. Smith, Anchorage; Finis E. Gentry, Prospect, both of Ky.

[73] Assignee: General Electric Company, Louisville, Ky.

[21] Appl. No.: 77,969

[22] Filed: Sep. 24, 1979

[51] Int. Cl.[3] ..... H05B 6/80

[52] U.S. Cl. ..... 219/10.55 R; 126/21 A; 219/10.55 B; 219/10.55 E

[58] Field of Search ..... 219/10.55 F, 10.55 B, 219/10.55 R, 10.55 E, 10.55 M, 400; 126/21 A

[56] References Cited

U.S. PATENT DOCUMENTS

| | | | |
|---|---|---|---|
| 2,860,026 | 11/1958 | Long | 219/10.55 F |
| 2,888,542 | 5/1959 | Mork | 219/10.55 F |
| 3,654,417 | 4/1972 | Javes et al. | 219/10.55 R |
| 3,692,968 | 9/1972 | Yasuoka | 219/10.55 F |
| 3,783,219 | 1/1974 | Tateda | 219/400 X |
| 3,884,213 | 5/1975 | Smith | 219/400 X |
| 3,985,990 | 10/1976 | Levinson | 219/10.55 E |
| 3,985,991 | 10/1976 | Levinson | 219/10.55 E |
| 4,091,252 | 5/1978 | Koinuma | 219/10.55 R |
| 4,093,841 | 6/1978 | Dills | 219/10.55 E |
| 4,096,369 | 6/1978 | Tanaka et al. | 219/10.55 D |
| 4,123,643 | 10/1978 | Burke | 219/10.55 R |
| 4,184,945 | 1/1980 | Morgan et al. | 219/10.55 R X |
| 4,211,909 | 7/1980 | Yoshida et al. | 219/10.55 R |

FOREIGN PATENT DOCUMENTS

| | | | |
|---|---|---|---|
| 2906501 | 8/1979 | Fed. Rep. of Germany | 219/10.55 E |
| 4934440 | 3/1974 | Japan | 219/10.55 R |

*Primary Examiner*—Arthur T. Grimley

*Attorney, Agent, or Firm*—Bernard J. Lacomis; Radford M. Reams

[57] ABSTRACT

A microwave oven for cooking food by means of both microwave energy and convective heating which includes within it, a substantially closed microwave transparent container into which food to be cooked is placed, a heating element for convectively heating air, and means for blowing air past the heating element and into the container.

8 Claims, 2 Drawing Figures

COMBINATION MICROWAVE/FORCED CONVECTION OVEN

BACKGROUND OF THE INVENTION

1. Field of the Invention

This invention relates to microwave ovens for cooking food, and particularly to a new and improved combination microwave/forced convection oven having a substantially closed cooking container therein and a separate heating element with means for circulating within the container air heated by the element, thus allowing cooking of the food by both convective and microwave heating.

2. Description of the Prior Art

Microwave ovens have become widely accepted in many countries for the cooking of many foods at a fast cooking rate. The microwave frequency energy is radiated within the oven cooking cavity from an energy source such as a magnetron. The waves are radiated and reflected within the oven cavity in free space and may be distributed by such means as mode stirrers, antennas, and the like. The microwave energy sets up a high frequency oscillatory movement of the molecules in the food to cause internal heating by molecular friction.

Microwave cooking, however, often produces no browning or other darkening of the surface of the food being cooked. Both the flavor and appearance, darkening is advantageous. One method for accomplishing this in the past has been to blow excess heat from the magnetron assembly into the microwave oven cavity, thus obtaining a convective heating effect. However, this method may prove unreliable and inefficient in that the amount of heat generated by the magnetron heat source is not readily controllable and the heat is distributed throughout the entire cavity rather than being concentrated in the locality of the food being cooked.

Another method for darkening the surface of food has been by exposing it directly to a radiant heating element located within the microwave cavity. However, this method requires periodic changing of the position of the food to ensure uniform darkening. A further disadvantage of both of the above methods is that the microwave oven itself, which remains at room temperature when only microwave energy cooking is employed, will become heated above room temperature, possibly presenting a safety hazard.

Another problem associated with microwave cooking is that of splatter resulting from escaping vapors and food particles which accumulate on the surfaces of the oven cavity and make cleaning difficult. A solution to this problem has been to place a tightly closed microwave transparent container inside the oven cavity to hold the food while it is being cooked. Although this solves the problem of splatter, the close tightness of the container precludes the use of convective heating as a means of darkening the surface of the food.

The primary object of the present invention is to provide new and improved means for convectively heating food in a microwave oven, and effective for darkening the surface of the food and contributing to the heating thereof, while it is simultaneously being heated by microwave energy.

Another object of the present invention is to obtain in a combination microwave/forced convection oven maximum advantage of the convective heating by confining the heated air to a substantially closed food container positioned within the microwave oven cavity, while at the same time allowing the remaining areas of the oven to remain at approximately room temperature.

Another object of the present invention is to provide in a combination microwave/forced convection oven a heating element of known thermal output and a means of known capacity for moving the air past the heating element, and thus effective for controlling the temperature and amount of convectively heated air in the oven.

Still another object of the present invention is to provide in a combination microwave/forced convection oven, means for confining vapors and food particles, thrown off by the food while it is being cooked, to a closed container.

SUMMARY OF THE INVENTION

The present invention, in accordance with one embodiment thereof, comprises a microwave oven having an oven cooking cavity and a source of microwave energy with means for coupling the energy to the oven cavity. A microwave transparent refractory closed cooking container is positionable in the oven cavity and includes an aperture in a wall thereof. A perforated plenum, built into a wall of the cavity and housing a heating element and a means for moving air past the heating element, protrudes into the aperture of the container and circulates hot air therein. Food placed in the container can thus be subjected to both convective and microwave heating. The container preferably comprises a glass casserole pan and a complementary cover with opposed side cutouts which cooperate to define the lateral aperture.

BRIEF DESCRIPTION OF THE DRAWING

This invention will be better understood from the following description taken in conjunction with the accompanying drawing and its scope will be pointed out in the appended claims.

DESCRIPTION OF THE PREFERRED EMBODIMENT

Figure 1:
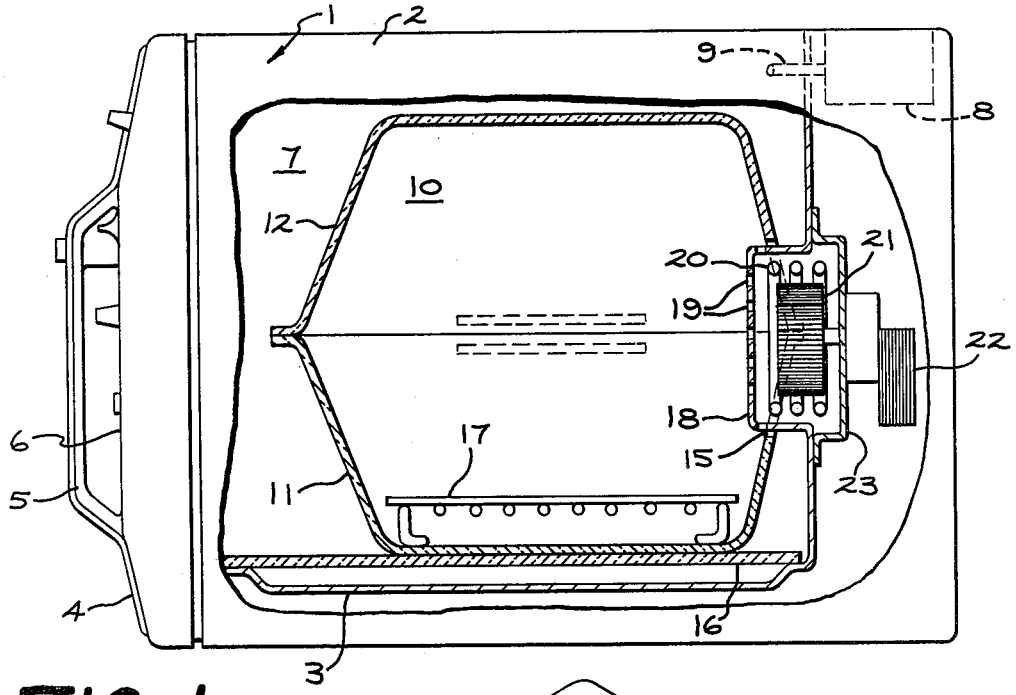
FIG. 1 is a right side elevational view of a countertop microwave oven with parts broken away and sectionalized to show the interior of the oven and the cooperation of certain parts including a substantially closed cooking container in the oven and a plenum which protrudes into the container and houses a heating element and impeller.
Figure 2:
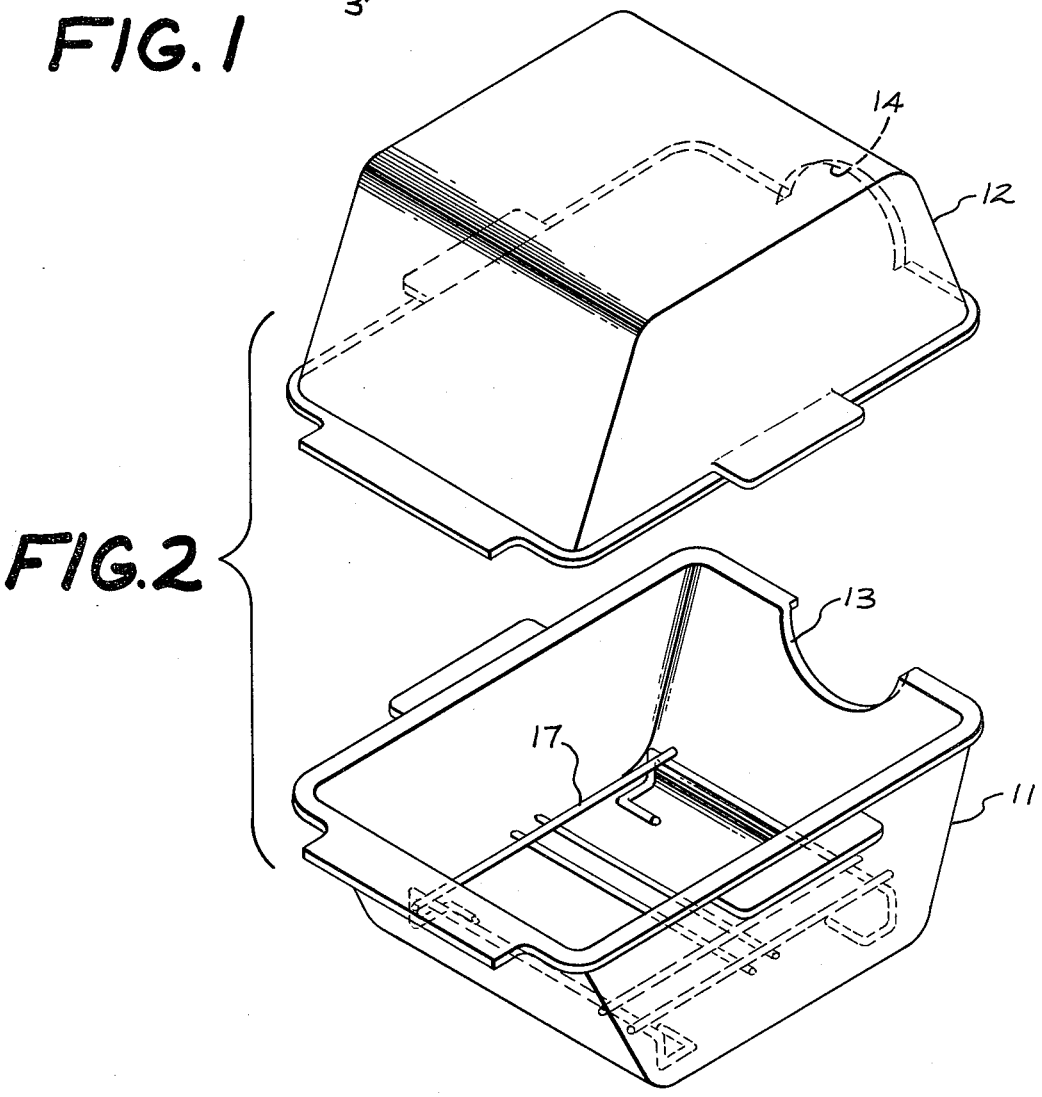
FIG. 2 is a perspective view of the upper and lower halves of the closed cooking container.

Turning now to a consideration of the drawing, and in particular to FIG. 1, there is shown a microwave oven 1 which is provided with an outer cover 2 that encloses a box-like oven liner 3. The liner 3 cooperates with a front opening access door 4, having a handle 5, for forming a microwave cooking cavity 7. To one side of the oven door 4 is a control panel 6 behind which is located an equipment compartment extending to the back of the oven and containing various control and power components for the apparatus. One of the power components is a source of microwave energy, which is preferably a magnetron generally indicated at 8. The magnetron 8 is coupled to the cavity 7 to supply microwave energy thereto. This may be accomplished in various ways well known in the art, including by use of an output antenna 9 as shown.

Positionable within the microwave cooking cavity 7 is a cooking container 10, comprising a pan section 11 and a cover 12, made of microwave transparent refractory material. More specifically, the container 10 can advantageously constitute a covered casserole dish formed of glass or any other material of the types widely used in microwave oven cookware. The pan 11 and cover 12 of container 10 have semicircular cutouts 13 and 14, respectively, on their corresponding rear edges, which, when the pan and cover are mated, cooperate to define a single circular aperture 15 in the backside of the container 10. The container 10, when positioned in the microwave cavity 7, rests on a shelf 16. A cooking rack 17 may be placed within the pan section 11 of the container 10 to elevate the food being cooked. In a manner to be discussed in greater detail hereinafter, the covered pan arrangement is effective for substantially entrapping within the container 10 vapors and food particles resulting from cooking food in the container.

In the apparatus discussed to this point, cooking is accomplished by microwave heating of the food. The present invention additionally provides means for cooking by convection heating and localizing the convection heating to the interior of the container 10. To this end, there is built into the oven a plenum 18 formed in the rear wall of the liner 3 and having a plurality of perforations or apertures 19 providing communication between the interiors of the plenum 18 and of the cavity 7. The plenum is cylindrical and has a diameter slightly less than that of the circular aperture 15 defined in the container 10 by the cooperating cutouts 13 and 14 in the pan 11 and cover 12, respectively. Additionally, the plenum 18 has a longitudinal length sufficient for it to protrude into the container 10 through the aperture 15 when the container 10 is properly positioned in the microwave cooking cavity 7. Thusly, when the container 10 is properly positioned in the cavity 7, it is substantially fully closed and in communication with the plenum 18.

Suitably supported in the plenum 18 is a heating element 20, which is preferably a helical electrical resistance heater. Also positioned within the plenum 18 is a means for moving air past the heating element 20, which is preferably a vane-type impeller 21 driven by a motor 22 mounted on a bracket 23 supported on the rear wall of the liner 3. Air within the container 10 is circulated into the plenum 18 by the impeller 21 through perforations 19. It is then forced past the heating element 20, and recirculated through other perforations 19 back into container 10. To best accomplish this, impeller 21 is mounted coaxially within the helical resistance heater 20. This preferred arrangement of impeller 21 and heater 20 also permits the length of plenum 18 to be shorter than would be required by other fan/heater arrangements. Food placed in the container 10 is thus subjected to convective heating as well as microwave heating. Additionally, the cover 12 and the close fit of the plenum 18 in the rear side of the container 10 results in the convective heat being substantially localized in the container and the food being cooked in a substantially closed container. These features serve to increase cooking efficiency and to contain cooking vapors and splattered food which reduces soiling of the interior of the cavity 7. Further, by confining the convectively heated air to container 10, the air in cavity 7 between the container 10 and the liner 3 will act as an insulator to keep the remainder of the microwave oven cool.

While a preferred embodiment of the present invention has been shown and described, it is to be understood that the closed container/convective heating means combination can be readily controlled for use independently of the microwave cooking process to warm food or to defrost frozen food, and of course, if desired, the microwave oven can be operated independently of the convective heating means. Further, when simultaneous microwave and convective heating is required, it may be desirable because of electrical power limitations to alternate the operation of the microwave and convective heating cycles on a predetermined timing schedule.

Modifications of this invention will occur to those skilled in this art; therefore, it is to be understood that this invention is not limited to the particular embodiment disclosed, and it is intended to cover all modifications coming within the true spirit and scope of this invention as claimed.

What is claimed is:

1. Cooking apparatus comprising an oven having walls defining a microwave cooking cavity, a source of microwave energy, means for coupling the energy from the microwave source to the cooking cavity, a substantially closed cooking container of microwave transparent refractory material removably positioned within said cavity and having an aperture, a perforated plenum built into a wall of said cavity and having a section which extends into said container through said aperture therein when said container is positioned in said cavity, and means for convectively heating food in said container by introducing heated air thereinto through said plenum.

2. Cooking apparatus according to claim 1, wherein said cooking container comprises a pan and a cooperating cover and said aperture therein is defined by corresponding cutouts in opposed edges of said pan and cover.

3. Cooking apparatus according to claim 1, wherein said plenum is cylindrical, said closed cooking container comprises a pan and a cover of a glass casserole dish, each having a semicircular cutout in a corresponding edge thereof, which cutouts cooperate to define a circular aperture to receive said plenum when the pan and cover are mated.

4. Cooking apparatus according to claim 1, wherein said means for convectively heating food in said container comprises a heating element mounted in said plenum, and means for moving air through said plenum past said heating element and into said container.

5. Cooking apparatus according to claim 4, wherein said heating element in the plenum comprises a helical electrical resistance heater.

6. Cooking apparatus according to claim 4, wherein said means for moving air through said plenum comprises a motor-driven impeller.

7. Cooking apparatus according to claim 4, wherein said heating element is helical, and said means for moving air is a motor-driven impeller coaxially mounted within said heating element.

8. Cooking apparatus comprising an oven having walls defining a microwave cooking cavity, a source of microwave energy, means for coupling energy from the microwave source to the cooking cavity, a substantially closed cooking container removably positioned within said cavity comprising a pan and a cover of a glass casserole dish, each having a semicircular cutout in a corresponding edge thereof, which cutouts cooperate to define a circular aperture, a perforated cylindrical plenum built into the rear wall of said cavity and a portion of which extends into said container through said circular aperture therein when said container is positioned in said cavity, means for convectively heating food in said container comprising a helical electrical resistance heater mounted in said plenum, means for circulating air from said container through said plenum past said heater and back into said container comprising a motor-driven impeller coaxially mounted within said heater in said plenum.

* * * * *